US008545189B2

(12) United States Patent
Venkatachari et al.

(10) Patent No.: US 8,545,189 B2
(45) Date of Patent: Oct. 1, 2013

(54) METHOD AND ARRANGEMENT FOR CONTROLLING A PUMPING STATION

(75) Inventors: Srikanth Venkatachari, Bangalore (IN); Mikael Holmberg, Porvoo (FI)

(73) Assignee: ABB Oy, Helsinki (FI)

( * ) Notice: Subject to any disclaimer, the term of this patent is extended or adjusted under 35 U.S.C. 154(b) by 1541 days.

(21) Appl. No.: 10/589,867

(22) PCT Filed: Mar. 15, 2005

(86) PCT No.: PCT/FI2005/000152

§ 371 (c)(1),
(2), (4) Date: Aug. 18, 2006

(87) PCT Pub. No.: WO2005/088134

PCT Pub. Date: Sep. 22, 2005

(65) Prior Publication Data

US 2007/0166169 A1 Jul. 19, 2007

(30) Foreign Application Priority Data

Mar. 16, 2004 (FI) ..... 20040401

(51) Int. Cl.
*F04B 49/00* (2006.01)

(52) U.S. Cl.
USPC ..... 417/36; 417/8; 417/20; 417/22

(58) Field of Classification Search
USPC ..... 417/8, 20, 22, 36
See application file for complete search history.

(56) References Cited

U.S. PATENT DOCUMENTS

| | | | | |
|---|---|---|---|---|
| 2,462,076 | A * | 2/1949 | Dryden | 417/36 |
| 4,945,491 | A * | 7/1990 | Rishel | 702/47 |
| 5,234,319 | A | 8/1993 | Wilder et al. | |
| 6,481,973 | B1 * | 11/2002 | Struthers | 417/36 |

FOREIGN PATENT DOCUMENTS

| | | |
|---|---|---|
| EP | 0 610 766 A | 8/1994 |
| EP | 0 619 431 A | 10/1994 |
| EP | 1 323 984 A | 7/2003 |

OTHER PUBLICATIONS

European Patent Office Search Report dated Jul. 23, 2007 and EPO form 2022 dated Jul. 16, 2007.

* cited by examiner

*Primary Examiner* — Charles Freay
*Assistant Examiner* — Philip Stimpert
(74) *Attorney, Agent, or Firm* — Young & Thompson

(57) ABSTRACT

A method and an arrangement for controlling a pump station includes measurement of the surface level of a liquid (465) by means of a sensor (452) and controlling the electric drive (401, 420, 430) of the pump (440) to a predetermined speed of rotation when a specific surface level value has been reached. This predetermined rotation speed value is preferably the rotation speed at which the ratio of the flow rate to the consumed power, i.e. the efficiency, is optimal. The measurement of the surface level and the related data processing for control of the pump are performed in a frequency converter (420) in conjunction with the control.

22 Claims, 5 Drawing Sheets

METHOD AND ARRANGEMENT FOR CONTROLLING A PUMPING STATION

FIELD OF THE INVENTION

The invention relates to a method and arrangement for controlling a pump station. The invention is most advantageously applied to a pump station connected to a tank or a reservoir.

BACKGROUND

Pump stations are used especially in municipal engineering, where they are typically connected to pure water tanks, rain water tanks or waste water reservoirs. The pump station is then intended to prevent the tank/reservoir from being emptied or filled depending on the application. Pump stations often comprise a measurement apparatus for determining the liquid surface level by measuring the liquid surface level and controlling the pump on the basis of the surface level.

Pump stations used for liquid transfer are usually composed of one or more electrically driven pumps. The electric drive consists of a suitable current supply circuit, an electric motor and a control unit suitable for controlling and/or adjusting the electric motor. The pump operates as a load on the electric drive. The most frequently used electric motor in pump systems is an alternating-current motor, especially an induction motor. An alternating-current motor is most conveniently controlled by a contactor, and then the motor is switched on/off in accordance with the liquid surface level. However, the control unit often consists of a frequency converter because of the benefits yielded by this. The speed of an electric motor is controlled with a frequency converter, which converts the frequency of the voltage supplied to the motor. The frequency converter, in turn, is adjusted by appropriate electric control signals.

A prior art pump station is illustrated in FIG. 1. The pump 140 is electrically driven, the electric drive consisting of power supply 101, a frequency converter 120 acting as the control unit and an alternating-current motor 130, which is a three-phase motor in this case. The motor is usually connected to the pump with the rotation speed of the motor and the rotation speed of the pump being equal. The power supply 101 comprises an alternating-current network, such as a three-phase network, or any similar alternating-current source for supplying electric energy to the electric drive.

The pump station illustrated in FIG. 1 comprises a liquid tank 160, liquid 165 accumulated in this being pumped with a pump 140 into an exhaust manifold 142. The liquid surface level in the tank is measured by two surface level sensors 151 and 152, which are connected to the control unit 150. Each of the surface level sensors gives the control unit a signal indicating whether the surface level is above or below the sensor, in other words, the sensor is of switch type. The control unit 150 controls the pump operation e.g. as follows. When the liquid surface level is below the lower sensor 152, the pump is stopped. The pump remains switched off until the liquid surface reaches the upper surface level sensor 151, and then the pump is fully activated. The pump is operating until the liquid surface reaches the lower surface level sensor 152, and then the pump stops. There are also applications in which the pump is intended for pumping liquid into the tank and for keeping the liquid amount within given limits. In that case, the control described above has reverse operation, i.e. when the liquid surface level is below the lower surface level sensor, the pump is activated, and when the liquid surface level is above the upper surface level sensor, the pump stops. The functions described above do not utilise the feature of controlling the rotation speed provided by the frequency converter.

Instead of surface level sensors of switch type, one could use e.g. a surface level sensor 152 based on pressure measurement, the sensor being located at the bottom of the tank and providing information about the surface level at all surface levels. In that case, one often uses a control arrangement in which a constant surface level is aimed at, with the rotation speed of the pump being continually adjusted in accordance with the liquid amount entering the tank or consumed from the tank.

In FIG. 1, the pump and its drive have been illustrated outside the liquid tank for the sake of clarity, yet pump stations commonly use also pump installations within the liquid tank, e.g. at the tank bottom. Prior art arrangements have been described e.g. in patent specifications EP 619431 B1 and EP 100390 B1.

Prior art solutions involve a number of drawbacks. Separate installation of measurement and control apparatus requires work at the mounting site, and the appropriate mounting site and arrangement for the equipment and the sensors often require specific planning for each installation. The conditions at the mounting site may also vary, and this requires the use of measurement and control devices of different types depending on the conditions at the mounting site.

In addition, in prior art solutions, the energy consumption and efficiency of the pump station depends on external factors, e.g. on the flow-time distribution of the liquid entering a tank to be emptied or of the liquid consumed from a tank to be filled. Thus, a pump station may have poor energy consumption efficiency. In addition, the operating speed of the pump may be—especially in continuously regulated systems—permanently so low that impurities, which risk to cause obstructions, gather in the piping because of the low flow. The drawbacks mentioned above increase the cost of installing the pump station, of the equipment and of the operation.

SUMMARY OF THE INVENTION

The purpose of the invention is to provide a new method and arrangement for controlling a pump station, the invention allowing the prior art drawbacks mentioned above to be eliminated or reduced.

The objectives of the invention are attained with a solution, in which the liquid surface level is measured, and when a given surface level value has been passed by, the electric drive of the pump is controlled to a predetermined rotation speed. This predetermined value of the rotation speed is preferably the rotation speed at which the rate of flow relative to the consumed power, i.e. the efficiency, is at maximum. The surface level is measured in connection with the control of the electric drive. The invention is applicable to pump stations comprising both one and more pumps.

The invention achieves significant advantages over prior art solutions:

- the invention avoids acquisition and installation of measurement and control apparatus separately.
- since the pump is principally operated with optimal efficiency, energy savings are achieved.
- since the pump is principally operated at a rotation speed yielding a high flow rate, accumulation of impurities in the piping with consequent obstructions are avoided especially in waste water plants.

In accordance with the present invention there is provided a method for controlling a pump station that comprises at least two pumps, each of the at least two pumps being arranged to transfer liquid from or into a tank and being controlled by an electric drive comprising a frequency converter. The method according to the invention comprises:

measuring a liquid surface level in the tank by means of a sensor, controlling activation of each of the at least two pumps on the basis of the measured liquid surface level, selecting a first value of the liquid surface level, selecting as a first value of pump rotation speed substantially a value at which amount of transferred liquid relative to consumed energy is at maximum, detecting a first moment when the liquid surface level reaches said first value of the liquid surface level from a predetermined direction, controlling, as a consequence of the detection of the first moment, the pump rotation speed of one of said at least two pumps to said first value of the pump rotation speed, running the one of said at least two pumps at the first value of the pump rotation speed in order to move the liquid surface level in a direction opposite to the predetermined direction, detecting a second moment when the liquid surface level reaches, from the direction opposite to the predetermined direction, another value of the liquid surface level that is later in the direction opposite to the predetermined direction than the first value of the liquid surface level, and controlling, as a consequence of the detection of the second moment, the one of said at least two pumps to be stopped so as to keep the surface level between the said first value and the other value of the liquid surface level, the change of amount of liquid in the tank when the surface level changes between said first value and the other value of the liquid surface level being smaller than the whole volume of the tank, wherein said at least two pumps are controlled at the pump station in such a way that said at least two pumps are alternately in such operating turns in which the pump rotation speed is said first value of the pump rotation speed and monitoring of the liquid surface level and the controlling of the pump rotation speeds are performed in the frequency converter.

In accordance with the present invention there is provided also a frequency converter for a pump station comprising a liquid tank, at least two pumps and electric drives for actuating the at least two pumps. The frequency converter according to the invention comprises:

means for storing a first value of liquid surface level, means storing a first value of pump rotation speed, the first value of the pump rotation speed being substantially a value at which amount of transferred liquid relative to consumed energy is at maximum, means for measuring the liquid surface level on the basis of a signal received from a sensor, means for detecting a first moment the liquid surface level reaches said first value of the liquid surface level from a predetermined direction, means for controlling the pump rotation speed of one of the at least two pumps to said first value of the pump rotation speed as a consequence of said detection of the first moment, means for running the one of said at least two pumps at the first value of the pump rotation speed in order to move the liquid surface level in a direction opposite to the predetermined direction, means for detecting a second moment when the liquid surface level reaches, from the direction opposite to the predetermined direction, another value of the liquid surface level that is later in the direction opposite to the predetermined direction than the first value of the liquid surface level, and means for controlling, as a consequence of the detection of the second moment, the one of said at least two pumps to be stopped so as to keep the surface level between the said first value and the other value of the liquid surface level, the change of amount of liquid in the tank when the surface level changes between said first value and the other value of the liquid surface level being smaller than the whole volume of the tank, and means for controlling the at least two pumps in such a way that said at least two pumps are alternately in such operating turns in which the pump rotation speed is said first value of the pump rotation speed, wherein the means for controlling comprises means for transmitting control data to one or more other frequency converters of the pump station for controlling the operating turns of the at least two pumps.

A number of embodiments of the invention are described in the dependent claims.

BRIEF DESCRIPTION OF THE FIGURES

The invention and its other advantages are explained in greater detail below with reference to the accompanying drawings, in which.

DESCRIPTION OF THE PREFERRED EMBODIMENT

Figure 1:
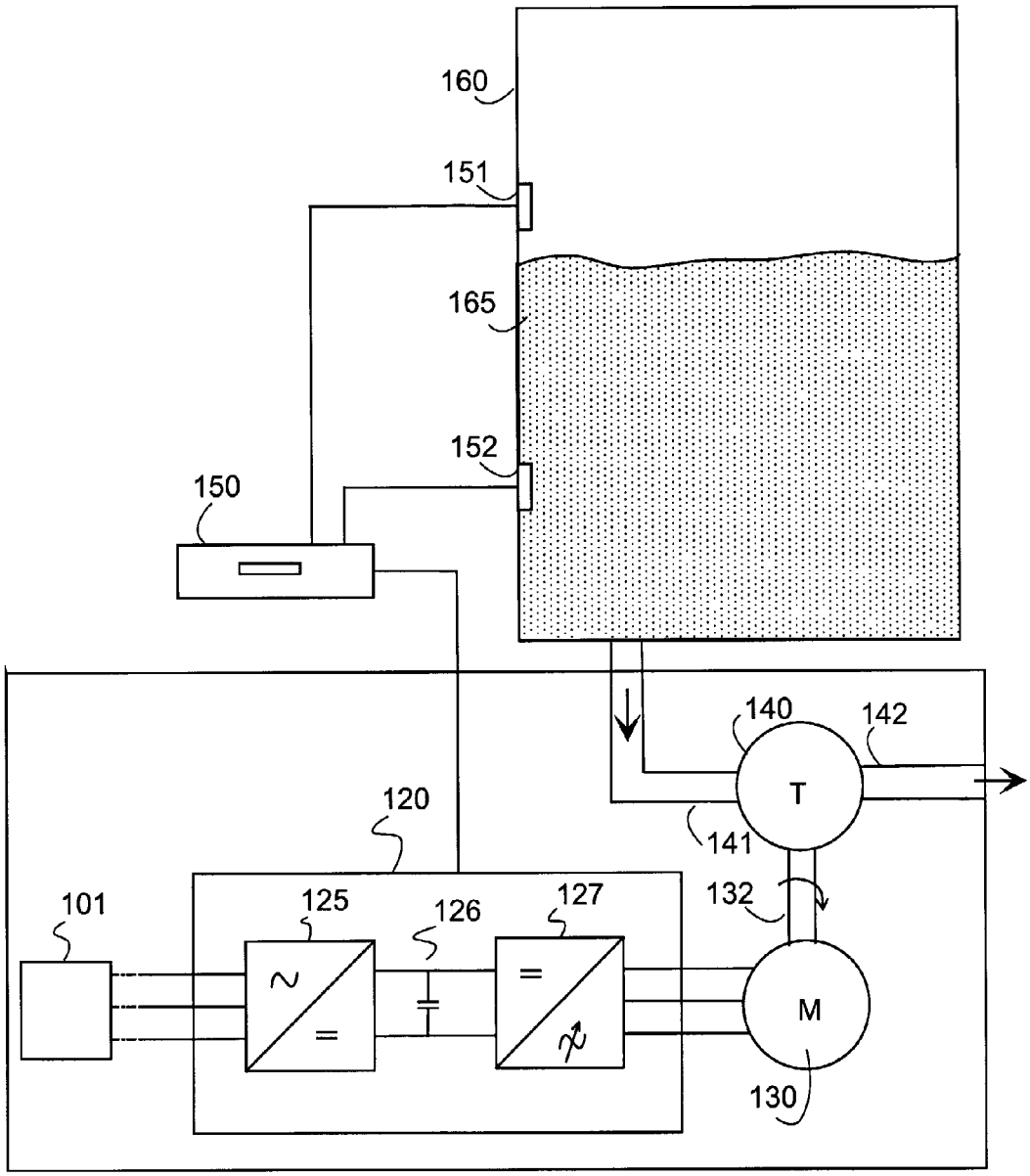
FIG. 1 PRIOR ART
FIG. 1 is a principal schematic view of a prior art pump station equipped with a frequency converter.

FIG. 1 has been explained above in conjunction with the description of prior art.

Figure 2:
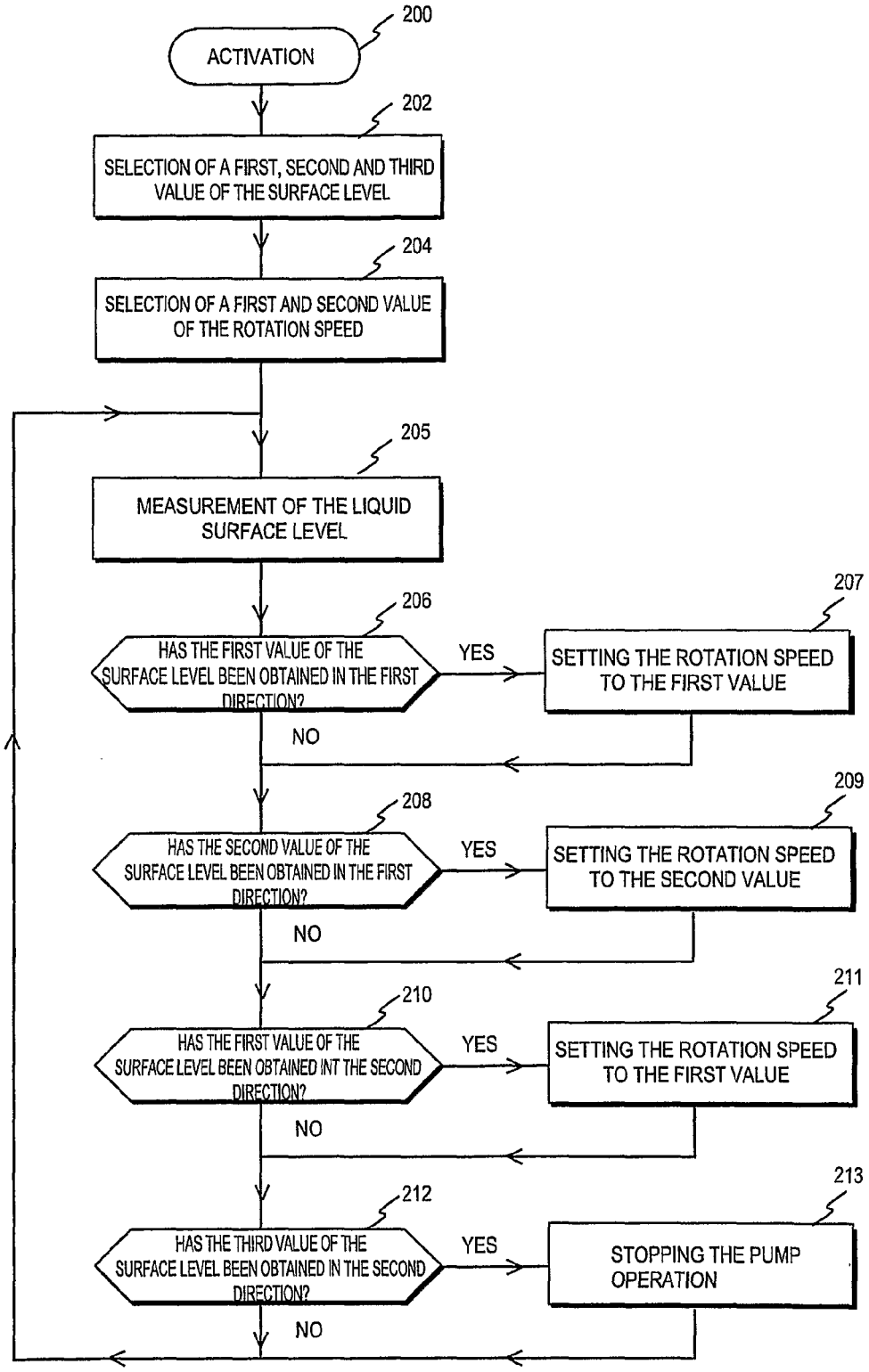
FIG. 2 is a flow chart of a method of the invention for controlling a pump station on the basis of the liquid surface level and FIG. 3*a* is a schematic diagram of the operation of the invention in a pump station comprising three pumps in some situations where the surface level changes.

FIG. 2 is a flow chart of a method of the invention for controlling a pump station. Step 200 illustrates the first activation of the pump system. Step 202 comprises selection of a first, second and third value of the surface level and storage of the values preferably in the controller of the frequency converter of the electric drive. The first surface level value is a central value among the three values. In the case of a pump application for emptying the tank, the second value of the surface level is the highest one and the third surface level value is the lowest one of the three values. When the surface level is below the lowest, i.e. the third value, the pump is switched off. Accordingly, when the surface level is above the highest, i.e. the second value, the pump is operated at the highest rotation speed.

Step 204 comprises selection of the first and second value of the rotation speed and storage of the values. The first value of the rotation speed is preferably the value at which the pump station operates at optimal efficiency. The second value of the rotation speed is a value of the rotation speed higher than the first value, preferably the maximum rotation speed and/or the rotation speed achieving the maximum flow value.

Step 205 comprises measurement of the surface level of the liquid, such as water, present in the tank/reservoir. The measurement is performed by means of a signal received from the surface level sensor in the electric drive, preferably a frequency converter. Next follows monitoring of whether the predetermined first, second or third value of the surface level have been reached from the predetermined direction. The first direction is then the one into which the liquid level moves when the pump is switched off and the second direction is the one into which the pump seeks to move the liquid surface during operation. Thus, for instance, in pump installation for emptying the tank, the first direction is the direction into which the liquid surface rises and the second direction is the one into which the liquid surface sinks. Accordingly, in a pump installation for filling the tank, the first direction is the one into which the liquid surface sinks and the second direction is the one into which the liquid surface rises.

Step 206 comprises checking of whether the liquid surface has reached the first value of the surface level from a first direction. If this has occurred after the previous measurement, the rotation speed of the pump is set to a first value, i.e. the value at which its efficiency is optimal, 207. Unless the first value of the surface level has been reached from the first direction, the system proceeds to step 208.

Step 208 comprises checking of whether the liquid surface has reached the second value from a first direction after the previous measurement. If this is the case, the rotation speed of the pump is set to the second value, i.e. the value that is preferably the maximum rotation speed, or a rotation speed yielding the maximum flow value, 209. Unless the second value of the surface level has been reached from a first direction, the system proceeds to step 210.

Step 210 comprises checking of whether the first value of the liquid surface has been reached from a second direction after the previous measurement. If this is the case, the rotation speed of the pump is set to the first value, 211. Unless the first value of the surface level has been reached from a second direction, the system proceeds to step 212. Steps 210 and 211 are not necessary, but instead, as the pump moves the liquid surface, it may operate also at the second, i.e. higher rotation speed value until the third surface level value has been reached.

Step 212 comprises checking of whether the third value of the liquid surface has been reached from a second direction after the previous measurement. If this is the case, the pump is stopped, 213. Finally step 205 is resumed for a new measurement of the surface level.

One or more values of the liquid surface level are advantageously varied, because this avoids or reduces accumulation of any solid constituents contained in the liquid on the tank wall at the selected surface level.

It should be noted that the steps above could be performed in a different order or simultaneously. The comparison of the measured surface level with predetermined values can be performed e.g. by analogue comparators or by comparing digital values in a processor.

When the pump station comprises two or more pumps associated with the same tank, their controls are preferably arranged such that the pumps are activated in turn during pumping of liquid in small amounts, for the pumps to wear evenly and to avoid damage to any pump due to lack of use over a long period. When a large liquid flow is necessary, several pumps are advantageously used at the same time. However, it is possible to reach an adequate flow even in systems of several pumps by means of one single pump, and in that case the pumps would wear unevenly if they were not operated in turns.

Figure 3A:
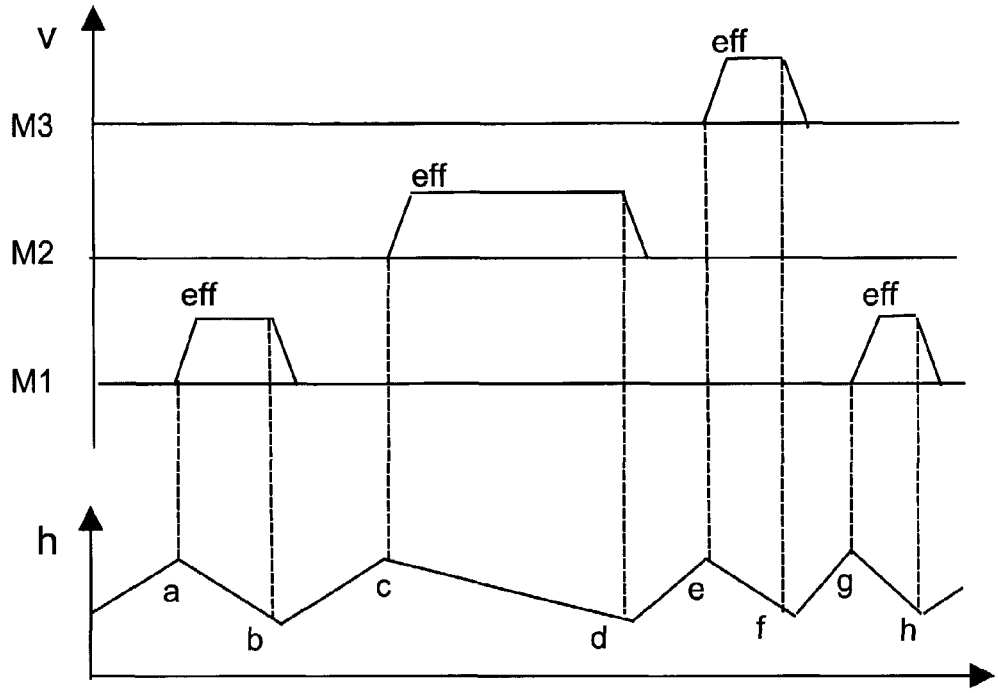

FIG. 3*a* illustrates a control of pumps of the invention as the liquid level h changes, with three pumps; M1, M2 and M3 and when the pumping requirement is small. This is an application where the pumps empty the tank. When the liquid level has risen to the first value of the surface level at moment a, the pump M1 is activated. The rotation speed v of the pump is set to a first value of the rotation speed, at which the efficiency of the pump is at maximum (eff). As the liquid level reaches the third value of the liquid surface as a consequence of emptying at moment b, the pump M1 is stopped.

When the liquid level has again risen to the first value of the surface level at moment c, pump M2 is activated in turn. The rotation speed of the pump is set to the first value of the rotation speed, at which the efficiency of the pump is at maximum (eff). As the liquid level reaches the third value of the liquid surface as a consequence of emptying at moment d, the pump M2 is stopped.

When the liquid level has again risen to the first value of the surface level at moment e, the pump M3 is activated in turn. The rotation speed of the pump is set to the first value of the rotation speed, at which the efficiency of the pump is at maximum (eff). As the liquid level reaches the third value of the liquid surface as a consequence of emptying at moment f, the pump M3 is stopped.

Subsequently, as the liquid surface next rises to the first value of the surface level at moment g, the pump M1 is activated again. As the liquid level reaches the third value of the liquid surface as a consequence of emptying at moment h, the pump M1 is stopped, etc.

As can be seen in FIG. 3*a*, the operations for switching on and off the pumps have been controlled to occur at a given retarded rate of changing the rotation speed, instead of sudden changes. This reduces the stresses exerted on the motor and the pump.

The controls of the different pumps are preferably coordinated by the control unit of the frequency converter of one pump. The data transfer between the different control units takes place by data transfer arrangements known per se, such as analogue/digital signals, by serial communications or via a field bus. In this case, the coordinating control unit of one pump transmits control data to the control units of the second/other pumps, which comprise means for receiving these control data from the coordinating control unit. Accordingly, data transfer arrangements between the control units can be used also for transferring surface level data from one control unit to another.

Figure 3B:
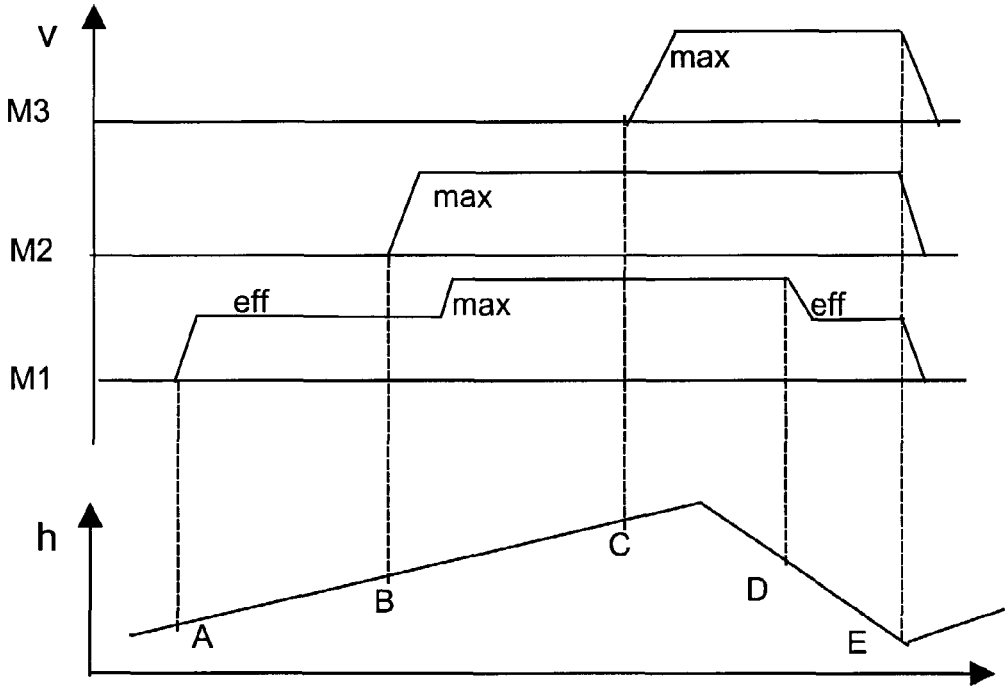
FIG. 3*b* is a schematic diagram of the operation of the invention in a pump station comprising three pumps in some other situations where the surface level changes.

FIG. 3*b* illustrates a similar control of pumps in accordance with the invention when the liquid level h changes and there are three pumps; M1, M2 and M3, and when pumping of water in large amounts is necessary. When the liquid level has risen to the first value of the surface level at moment A, the pump M1 is activated. The rotation speed v of the pump is set to a first value of the rotation speed, at which the efficiency of the pump is at maximum (eff). The flow of the pump M1 does not, however, suffice for emptying the tank, but the liquid level continues to rise. When the liquid surface level reaches the following limit value, pump M2 is also switched on at moment B. Pump M2 is preferably set to the second value of the rotation speed (max), at which the rotation speed and/or flow are at maximum. After a given delay, also pump M1 is set to a second higher value (max) of the rotation speed. However, the flow of pumps M1 and M2 is not enough for emptying the tank in this case, but the liquid level goes on rising.

When the liquid surface level reaches the following limit value, also pump M3 is activated at moment C. Pump M3 is also preferably set to a second value of the rotation speed (max) at which the rotation speed and/or flow are at maximum. When all the three pumps have reached their maximum operation, the liquid level starts sinking. When the liquid level reaches the following level threshold value at moment D, the pump M1 is set to the first value (eff) of the rotation speed. When the liquid surface level has sunk to its lowest threshold value at moment E, all the three pumps are switched off.

Figure 4:
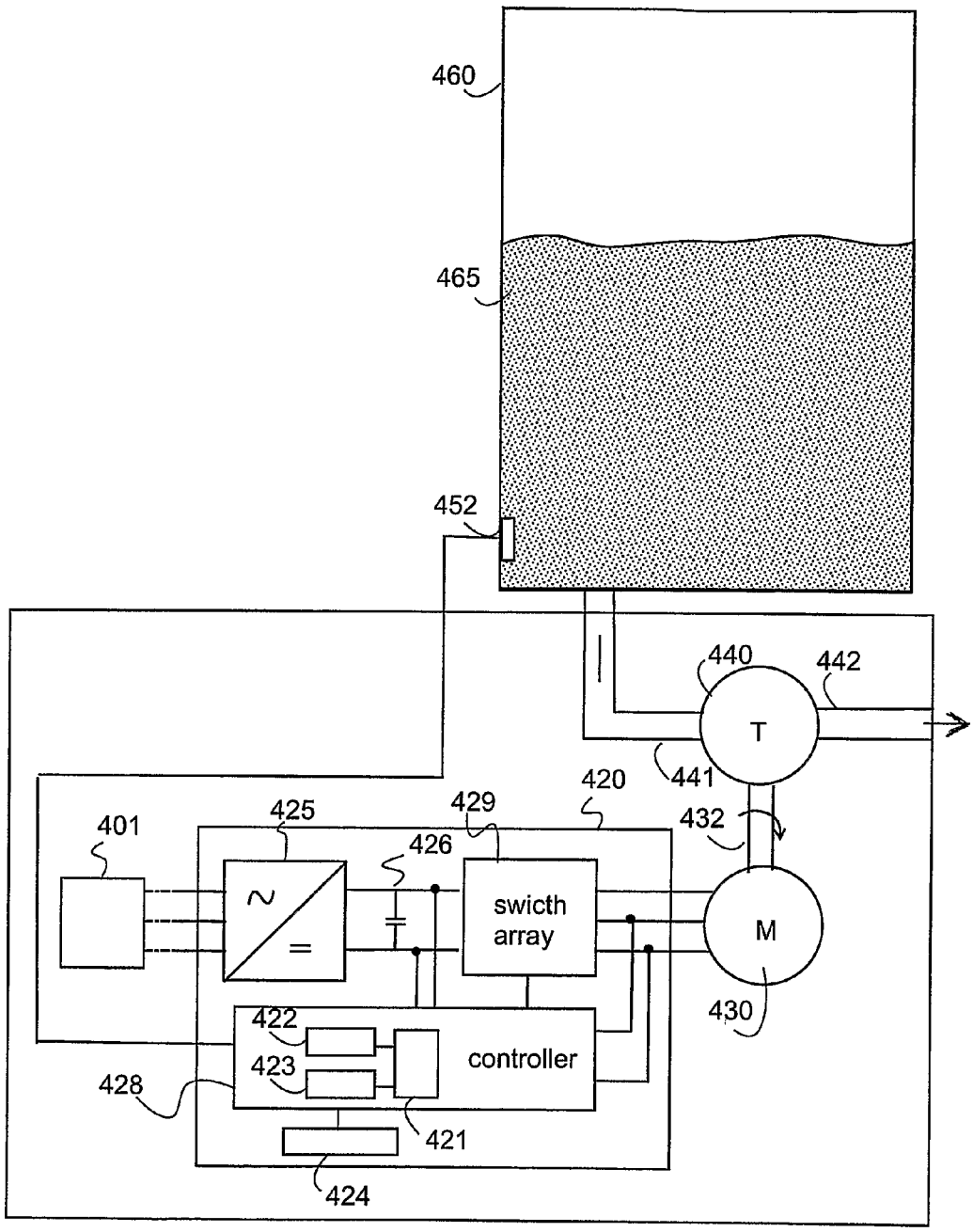
FIG. 4 is a block diagram of a pump arrangement of the invention and FIG. 5 illustrates the installation of a pump station of the invention.

FIG. 4 is a block diagram of a pump station In accordance with the invention. The system comprises an electric drive, which actuates the pump 440 and consists of an electric supply 401, a frequency converter 420 and an alternating-current motor 430. The frequency converter 420 shows a separate control unit 428 controlling switches 429 and performing the control of the operation of the frequency converter. The control unit also performs the control of the drive on the basis of the measurement value of the surface level of the liquid 465 in the tank/reservoir 460. In accordance with the present invention. The control unit receives a signal proportional to the surface level of the liquid 465 from the surface level sensor 452 over a terminal in the controller. The control unit may also comprise a terminal for transferring surface level data to a control unit controlling a second pump or for receiving surface level data from a control unit controlling a second pump. In addition, the control unit may comprise an input or output terminal, by means of which data are transferred by one or more controllers in a pump station comprising several pumps. This enables the pumps to be operated alternately and simultaneously if necessary.

The control unit 428 comprises preferably a processor 421, which monitors the liquid surface level and controls the functions of the frequency converter on the basis of the software. The control unit also comprises a memory unit 422 for storage of reference values of the surface level, selected values of the rotation speed of the motor and programs controlling the processor. The control unit also comprises a measurement unit 423, which receives and processes signals from one or more surface level sensors. The control unit is preferably connected also with an interface 424 having a keyboard and a display. The keyboard serves for feeding parameters used in the control and the display may show e.g. surface level data and information about the state of the electric drive.

The control unit may further comprise an input terminal for receiving alarm signals obtained from alarm sensors in the pump. Such alarm sensors typically consist of a temperature sensor or a leakage sensor. The control unit preferably controls the pump on the basis of a received alarm signal so that the control unit stops the pump after having received an active alarm signal. In such a situation, the control unit preferably transmits an alarm signal to the monitoring room. The control unit may carry out a similar alarm function to the monitoring room e.g. when the liquid surface value exceeds the predetermined alarm limit.

For controlling the processor, software has been stored in the memory of the control unit in order to enable the processor to control the functions of the frequency converter. The software has preferably been disposed to control the control unit to perform at least one of the following functions:

measurement of the liquid surface level on the basis of a signal from the sensor and control of the rotation speed of the pump on the basis of the liquid surface level, coordination of the control of at least two pumps so that the pumps are activated in turns, variation of at least one selected value of the liquid surface level in order to avoid that solid ingredients in the liquid gather on the wall of the tank at the selected surface level;

performing an alarm function when the liquid surface level exceeds a predetermined alarm limit value, and monitoring the alarm signals from the alarm sensors of the pump and controlling the pump on the basis of the alarm signals.

Figure 5:
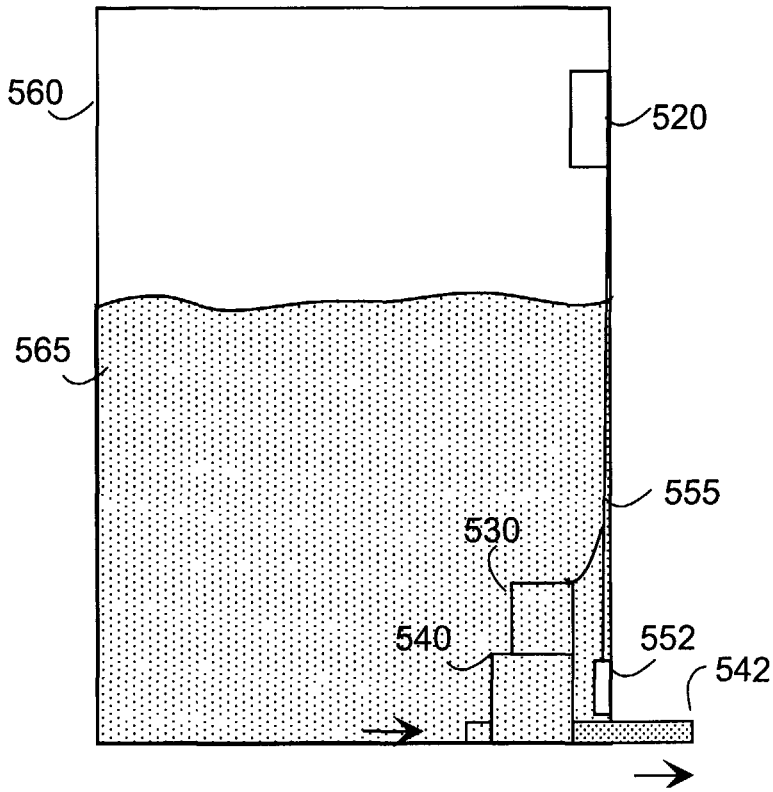

FIG. 5 illustrates a pump station in accordance with the invention. A pump 540 is disposed at the bottom of the tank 560 for pumping liquid into the exhaust pipe 542. A motor 530 for driving the pump is connected with the pump. A frequency converter and its controller 520 are provided at the top of the tank 560. Power supply has been provided from the frequency converter to the motor and a connection has been arranged to the surface level sensor by cabling 552.

It should be noted that the examples above use a surface level sensor, whose signal gives the value of the surface level each time the surface level is above the sensor. However, in the solution of the invention, surface level switches placed at the desired levels can, of course also be applied. The surface level can also be measured in many other ways, by means of an ultrasonic sensor, for instance.

It should also be noted, that, although an individual frequency converter having a separate control unit controls each of the pumps in the examples above, the frequency converters and/or control units of several pumps can naturally be combined into one single unit.

Although the major application of the present invention relates to water transfer, the invention can naturally be implemented in connection with other liquids as well.

The invention is not restricted merely to the embodiment example above, but many other modifications are conceivable without departing from the scope of the inventive idea defined by the independent claims.

The invention claimed is:

1. A method for controlling a pump station, that comprises at least two pumps, each of the at least two pumps being arranged to transfer liquid from or into a tank and being controlled by an electric drive comprising a frequency converter, the method comprising operating the at least two pumps in turns through the steps of:

measuring a liquid surface level in the tank by means of a sensor, controlling activation of each of the two pumps on the basis of the measured liquid surface level, selecting a first value of the liquid surface level, selecting as a first value of pump rotation speed substantially a predetermined value at which an amount of transferred liquid relative to consumed energy is at maximum, detecting a first moment when the liquid surface level reaches said first value of the liquid surface level from a predetermined direction, controlling, as a consequence of the detection of the first moment, the pump rotation speed of one of said at least two pumps to said first value of the pump rotation speed, running the one of said at least two pumps at the first value of the pump rotation speed in order to move the liquid surface level in a direction opposite to the predetermined direction, detecting a second moment when the liquid surface level reaches, from the direction opposite to the predetermined direction, another value of the liquid surface level that is later in the direction opposite to the predetermined direction than the first value of the liquid surface level, and controlling, as a consequence of the detection of the second moment, the one of said at least two pumps to be stopped so as to keep the surface level between said first value and the other value of the liquid surface level, the change of amount of liquid in the tank when the surface level changes between said first value and the other value of the liquid surface level being smaller than the whole volume of the tank, wherein said at least two pumps are controlled at the pump station in such a way that said at least two pumps are alternated in operating turns in which the pump rotation speed is said first value of the pump rotation speed and monitoring of the liquid surface level and the controlling of the pump rotation speeds are performed in the frequency converter.

2. A method as defined in claim 1, wherein the tank is filled by means of said at least two pumps at the pump station, said predetermined direction is from a top towards a bottom of the tank.

3. A method as defined in claim 1, wherein the tank is emptied by means of said at least two pumps at the pump station, said predetermined direction being from a bottom towards a top.

4. A method as defined in claim 1, wherein one of said at least two pumps is a currently operating pump, and the method further comprises selecting a second value of the pump rotation speed and detecting a moment at which the liquid surface level reaches a second value of the liquid surface level from said predetermined direction, and as a consequence of this detection, controlling the pump rotation speed of the currently operating pump to the second value of the pump rotation speed, the second value of the liquid surface level being later in the predetermined direction than the first value of the liquid surface level.

5. A method as defined in claim 4, wherein said second value of the pump rotation speed is the maximum rotation speed.

6. A method as defined in claim 4, wherein the method further comprises selecting a third value of the pump rotation speed, and detecting while a first pump, of said at least two pumps, is operating, a moment at which the liquid surface level reaches a third value of the liquid surface level from said predetermined direction, and activating as a consequence of this detection, a second pump, of said at least two pumps, that is not currently operating to operate at said third value of the pump rotation speed, the third value of the liquid surface level being later in the predetermined direction than the first value of the liquid surface level.

7. A method as defined in claim 1, wherein said first value of the liquid surface level and the first value of the pump rotation speed are stored in the frequency converter of the pump station.

8. A method as defined in claim 1, wherein said measurement of the liquid surface level is performed in the frequency converter on the basis of a signal received from the sensor.

9. A method as defined in claim 1, wherein an alarm signal is received from an alarm sensor of each of the at least two pumps and the pump is controlled on the basis of the alarm signal received from that pump.

10. A method as defined in claim 1, wherein an alarm function is performed when the liquid surface level exceeds a selected alarm limit value that is later in the predetermined direction than the first value of the liquid surface level.

11. A method as defined in claim 1, wherein the method further comprises varying the first value of the liquid surface level in order to avoid that solid constituents in the liquid gather on the wall of the tank at any fixed surface level.

12. A frequency converter for a pump station, the pump station comprising a liquid tank, at least two pumps and electric drives for actuating the at least two pumps, the frequency converter comprising:

means for storing a first value of liquid surface level, means for storing a first value of pump rotation speed, the first value of the pump rotation speed being substantially a predetermined value at which an amount of transferred liquid relative to consumed energy is at maximum, means for measuring the liquid surface level on the basis of a signal received from a sensor, means for detecting a first moment when the liquid surface level reaches said first value of the liquid surface level from a predetermined direction, means for controlling the pump rotation speed of one of the at least two pumps to said first value of the pump rotation speed as a consequence of said detection of the first moment, means for running the one of said at least two pumps at the first value of the pump rotation speed in order to move the liquid surface level in a direction opposite to the predetermined direction, means for detecting a second moment when the liquid surface level reaches, from the direction opposite to the predetermined direction, another value of the liquid surface level that is later in the direction opposite to the predetermined direction than the first value of the liquid surface level, means for controlling, as a consequence of the detection of the second moment, the one of said at least two pumps to be stopped so as to keep the surface level between said first value and the other value of the liquid surface level, the change of amount of liquid in the tank when the surface level changes between said first value and the other value of the liquid surface level being smaller than the whole volume of the tank, and means for controlling the at least two pumps in such a way that said at least two pumps are alternately in such operating turns in which the pump rotation speed is said first value of the pump rotation speed, wherein the means for controlling comprises means for transmitting control data to one or more other frequency converters of the pump station for controlling the operating turns of the at least two pumps.

13. A frequency converter as defined in claim 12, comprising means for storing a second value of the pump rotation speed and means for detecting a moment the liquid surface level reaches a second value of the liquid surface level from said predetermined direction, and means for controlling the pump rotation speed of the pump currently operating to the second value of the pump rotation speed as a consequence of this detection, the second value of the liquid surface level being later in the predetermined direction than the first value of the liquid surface level.

14. A frequency converter as defined in claim 13, wherein said second value of the pump rotation speed is the maximum rotation speed.

15. A frequency converter as defined in claim 12, comprising means for at least one of transmitting and receiving data indicating the liquid surface level to another frequency converter.

16. A frequency converter as defined in claim 12, comprising a memory unit for storage of said first value of the liquid surface level and the first value of the pump rotation speed and also for storage of a program for controlling the electric drive.

17. A frequency converter as defined in claim 12, comprising a measurement unit for receiving a signal from the sensor and for determining the liquid surface level on the basis of the received signal.

18. A frequency converter as defined in claim 12, comprising a terminal for connecting the sensor.

19. A frequency converter as defined in claim 12, comprising a processor for controlling the electric drives on the basis of data indicating the liquid surface level and on the basis of a program for controlling the processor.

20. A frequency converter as defined in claim 12, comprising means for receiving an alarm signal from alarm sensors of the at least two pumps and means for controlling the at least two pumps on the basis of the received alarm signal.

21. A frequency converter as defined in claim 12, comprising means for performing an alarm function if the liquid surface level exceeds a predetermined alarm limit value or if an alarm signal has been received from an alarm sensor of any of the at least two pumps, the predetermined alarm limit value being later in the predetermined direction than the first value of the liquid surface level.

22. A frequency converter as defined in claim 12, comprising software stored in the frequency converter for controlling the frequency converter to perform at least one of the following functions:

measurement of the liquid surface level on the basis of a signal from the sensor and control of the rotation speed of the pump on the basis of the liquid surface level, variation of the first value of the liquid surface level in order to avoid that solid ingredients in the liquid gather on the wall of the tank at any fixed surface level, performing an alarm function when the liquid surface level exceeds a predetermined alarm limit value that is later in the predetermined direction than the first value of the liquid surface level, and monitoring alarm signals received from alarm sensors of the at least two pumps and controlling the at least two pumps on the basis of the alarm signals.

* * * * *

UNITED STATES PATENT AND TRADEMARK OFFICE

CERTIFICATE OF CORRECTION

PATENT NO. : 8,545,189 B2
APPLICATION NO. : 10/589867
DATED : October 1, 2013
INVENTOR(S) : Venkatachari et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1652 days.

Signed and Sealed this
Fifteenth Day of September, 2015

Michelle K. Lee

Michelle K. Lee
*Director of the United States Patent and Trademark Office*